US010813832B2

(12) United States Patent
Qiu

(10) Patent No.: US 10,813,832 B2
(45) Date of Patent: Oct. 27, 2020

(54) MOVABLE BAREFOOT MASSAGE GRABBING BAR RACK

(71) Applicant: Qinglin Qiu, Broomfield, CO (US)

(72) Inventor: Qinglin Qiu, Broomfield, CO (US)

( * ) Notice: Subject to any disclaimer, the term of this patent is extended or adjusted under 35 U.S.C. 154(b) by 0 days.

(21) Appl. No.: 16/167,489

(22) Filed: Oct. 22, 2018

(65) Prior Publication Data

US 2020/0121555 A1 Apr. 23, 2020

(51) Int. Cl.

| | |
|---|---|
| ***A61H 37/00*** | (2006.01) |
| ***A63B 1/00*** | (2006.01) |
| ***A47F 5/10*** | (2006.01) |
| ***A61H 39/04*** | (2006.01) |

(52) U.S. Cl.

CPC ..... *A61H 37/00* (2013.01); *A47F 5/103* (2013.01); *A63B 1/00* (2013.01); *A61H 39/04* (2013.01); *A61H 2201/0134* (2013.01); *A61H 2203/0468* (2013.01)

(58) Field of Classification Search

CPC ..... A61H 37/00; A61H 39/04; A61H 2201/0134; A61H 2203/0468; A61H 2201/1284; A61H 2205/081; A61H 2003/006; A63B 1/00; A63B 3/00; A47F 5/10; A47F 7/19; A47F 7/24; A47F 5/103; A47G 25/0664; A47G 25/06; A47G 25/0692; A47B 43/00; A47B 45/00; A47B 96/14; A47B 96/145; A47B 47/005; A47B 47/02; A47B 47/027

USPC ..... 211/206, 204, 103, 85.7, 182, 175; D21/679, 686, 691; 482/42, 38, 41

See application file for complete search history.

(56) References Cited

U.S. PATENT DOCUMENTS

| | | | | | |
|---|---|---|---|---|---|
| 860,517 | A * | 7/1907 | Berglund | A63B 3/00 | 482/41 |
| 1,495,536 | A * | 5/1924 | Smith | A63B 1/00 | 482/38 |
| 1,538,272 | A * | 5/1925 | Cook | A63B 9/00 | 482/38 |
| 2,690,789 | A * | 10/1954 | Zadrozny | A61H 3/00 | 482/42 |
| 2,932,510 | A * | 4/1960 | Kravitz | A63B 3/00 | 482/38 |
| 3,117,760 | A * | 1/1964 | Dresbach | A63B 1/00 | 248/188.5 |
| 3,554,585 | A * | 1/1971 | Sorenson | A63B 3/00 | 403/105 |

(Continued)

*Primary Examiner* — Jennifer E. Novosad
(74) *Attorney, Agent, or Firm* — Michael D. Eisenberg

(57) ABSTRACT

A moveable grabbing bar rack for use in barefoot massage treatments, the present invention provides a moveable grabbing bar rack for use in barefoot massage treatments utilizing foot pressure. The movable grabbing bar rack is height position adjustable and collapsible for ease to be packed in a portable bag. The grabbing bar rack includes five independent components: first and second substantial triangular shaped bases, a pair of independent upright beams, a substantial rectangular shaped grabbing bar assembly, which includes a pair of parallel round-shaped beams working as a pair of grabbing bars, users only manually engaging the grabbing bars for body balance, and sometimes prostrate upon the upper grabbing bar with their abdomen. This rack is able to be moving forward and backward freely when in the performance of massage, because it is light weighted.

5 Claims, 9 Drawing Sheets

(56) References Cited

U.S. PATENT DOCUMENTS 3,593,708 A * 7/1971 Steele ..... A61H 1/0218 602/32
3,653,658 A * 4/1972 Robertson ..... A63B 3/00 482/42
3,707,285 A * 12/1972 Martin ..... A63B 1/00 482/38
3,896,798 A * 7/1975 Simon ..... A61H 1/0229 606/241
4,241,914 A * 12/1980 Bushnell ..... A63B 1/00 482/130
4,312,452 A * 1/1982 Waier ..... B60R 25/00 188/32
4,380,298 A * 4/1983 Harig ..... A47F 5/13 211/182
4,415,150 A * 11/1983 Iezza ..... A63B 3/00 211/182
4,503,845 A * 3/1985 Licciardi ..... A61H 1/0218 482/144
4,878,303 A * 11/1989 Banniza ..... G09F 7/20 40/606.14
4,904,110 A * 2/1990 Klein ..... A47B 96/1408 403/379.3
4,934,015 A * 6/1990 Mink ..... A47L 4/04 15/268
5,156,580 A * 10/1992 Holland ..... A63B 1/00 482/38
D346,081 S * 4/1994 Turner ..... D6/681.1
5,306,220 A * 4/1994 Kearney ..... A63B 23/00 482/104
5,346,448 A * 9/1994 Sollo ..... A63B 21/00181 482/104
5,535,898 A * 7/1996 Burgess, Sr. ..... B62B 3/108 211/189
D381,715 S * 7/1997 Reeder ..... D21/691
5,644,994 A * 7/1997 Liang ..... A47B 3/083 108/116
5,653,349 A * 8/1997 Dana ..... F16B 12/34 211/189
5,720,697 A * 2/1998 Winkel ..... A63B 3/00 434/255
6,302,828 B1 * 10/2001 Martin ..... A61H 3/008 482/43
6,308,842 B1 * 10/2001 Robbins, III ..... A47F 5/0006 206/494
6,382,434 B1 * 5/2002 Silberg ..... A47F 5/137 211/195
6,644,484 B1 * 11/2003 Sardis ..... A47B 43/00 211/189
D487,124 S * 2/2004 Toniolo ..... D21/691
6,702,130 B1 * 3/2004 Carlilse ..... B05B 13/0285 118/500
7,476,187 B2 * 1/2009 Corte ..... A63B 1/00 482/141
7,635,322 B2 * 12/2009 Parrilla ..... A63B 21/078 482/104
7,717,837 B2 * 5/2010 Florczak ..... A63B 1/00 482/143
D667,904 S * 9/2012 DeFrancisci ..... D21/691
8,534,470 B1 * 9/2013 Lin ..... A47F 5/137 211/13.1
8,770,535 B1 * 7/2014 Yu ..... G10G 5/00 211/85.6
8,959,813 B2 * 2/2015 Denby ..... A47F 5/10 211/175
D736,548 S * 8/2015 Hornsby ..... D6/681.1
9,278,246 B2 * 3/2016 Tambornino ..... A63B 21/078
D753,940 S * 4/2016 Ruiz ..... D6/681
D777,483 S * 1/2017 Bittle ..... D6/681
9,895,564 B1 * 2/2018 Katz ..... A63B 17/02
D828,057 S * 9/2018 Yaguchi ..... D6/681
2003/0168487 A1 * 9/2003 Lane ..... B60R 9/06 224/499
2004/0045483 A1 * 3/2004 Hardee ..... A61G 13/009 108/35
2004/0222179 A1 * 11/2004 Garcia ..... A47B 87/0223 211/206
2005/0209054 A1 * 9/2005 Thomas Lebert ..... A63B 1/00 482/41
2006/0160681 A1 * 7/2006 McBride ..... A63B 1/00 482/123
2009/0023566 A1 * 1/2009 Florczak ..... A63B 1/00 482/142
2010/0105532 A1 * 4/2010 Israeli ..... A63B 1/00 482/131
2010/0190612 A1 * 7/2010 Cook ..... A63B 71/023 482/38
2011/0152046 A1 * 6/2011 Rochford ..... A63B 21/04 482/131
2012/0007343 A1 * 1/2012 Webster ..... B62B 3/008 280/659
2012/0329613 A1 * 12/2012 Schiano ..... A63B 21/078 482/94
2013/0225372 A1 * 8/2013 Rochford ..... A63B 1/00 482/38
2013/0345026 A1 * 12/2013 Eberflus ..... A63B 1/00 482/38
2014/0152063 A1 * 6/2014 Huang ..... A45F 3/24 297/273
2016/0023035 A1 * 1/2016 Meyer ..... A63B 1/00 482/38

* cited by examiner

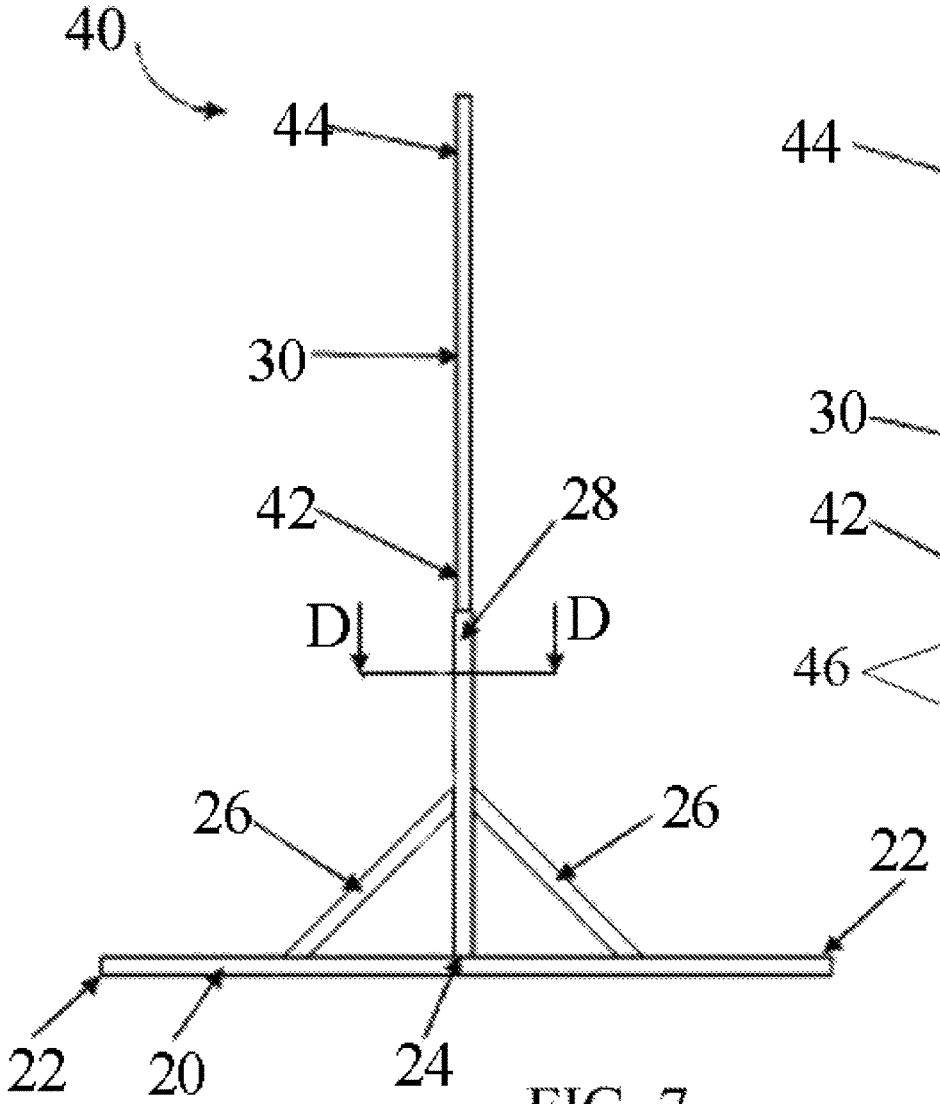
FIG. 7
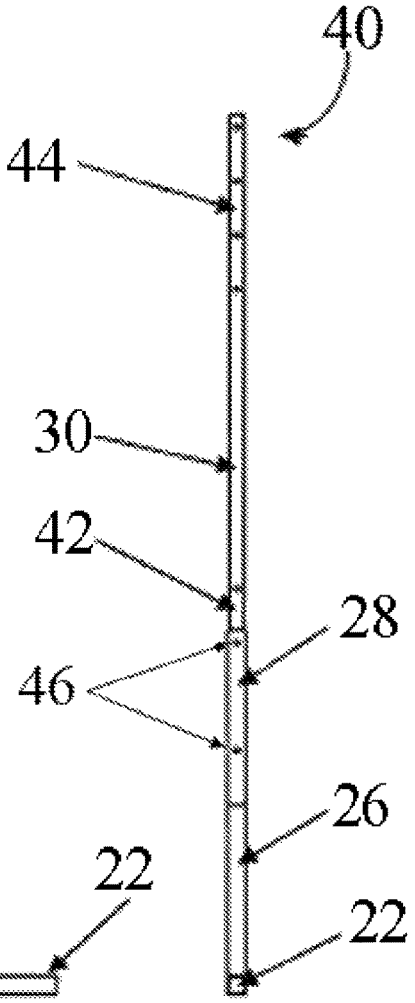
FIG. 8
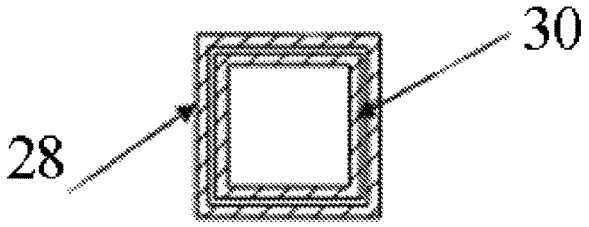
D-D FIG. 9

MOVABLE BAREFOOT MASSAGE GRABBING BAR RACK

CROSS-REFERENCE TO RELATED APPLICATIONS

This non-provisional application claims the benefit of Provisional application No. 62/068,676 filed on Oct. 25, 2014, and this is the continue-in-parts application for Non-provisional application Ser. No. 14/874,455 filed on Oct. 4, 2015

FEDERALLY SPONSORED RESEARCH OR DEVELOPMENT

Not Applicable

INCORPORATION BY REFERENCE OF MATERIAL

Submitted on a Compact Disk

Not Applicable

BACKGROUND OF THE INVENTION

Barefoot massage has been practiced for more than two millennium years in China. At very beginning, barefoot massage is one kind of treatment for the lumbar vertebrate of human body. However, since this century, the barefoot massage extensively has been practiced for health care business. Recent research shows, many western massage therapists have been turned to barefoot massage, because the deep-tissue massage therapy is more popular, but it requires massage therapists perform vigorous massage by their wrists and thumbs. So the barefoot massage can replace hands-on massage with wrists and thumbs, to avoid the pain and the chronic injury to many massage therapists using such techniques.

However, up to now, there is no any ideal bar equipment to support the massage therapists' bodyweight and keep it in balance, in order to give the massage therapists' feet more freedom. Traditionally a pair of paralleled beams is permanently installed, positioned overhead the massage therapists, and is not readily to a desired height for use upon different surface or for use between users of varying stature. Moreover, the overhead situation typical of most such supports exerts stress on the user's arms during the performance of the massage, result in their barefoot massage operations not safe.

The present invention, therefore, has changed the way to support the user's bodyweight and keep it in balance, utilizing a pair of transverse grabbing bars below the users' chest: A. in the most situations, users' one foot standing, on foot working, only required to manually engaging the grabbing bars; B. in a few of situations, users prostrate upon the upper grabbing bar with their abdomen, and two hands grasp the lower grabbing bar, when users working with two feet. In this way, massage therapists are able to adjust the pressure on feet by two hands changing the angle between the body and the grabbing bar rack.

The present invention therefore, enables erection of a moveable barefoot massage grabbing bar rack across a massage table, bed, mat, or other raised surface or ground surface, whereby engagement of a pair of movable transverse bars to support body balance and their abdomen enables users to self-support themselves during a barefoot massage, taking a pair of independent vertical upright beams with right length first, and then choosing the height position of the grabbing bar assembly between three positions appropriate for use for varying stature. This grabbing bar rack is also easily to be moving forward and backward to change its positions during the performance of massage.

FIELD OF THE INVENTION

The present invention is lightweight, portable, erectable, and height expediently adjustable. This present invention thus relates to the massage arts—particularly ashiatsu, "walking-back-massage", which totally replaces a pair of traditional paralleled beams permanently installed, positioned overhead the users, enables massage therapists provide barefoot massage to replace their hands-on massage.

SUMMARY OF THE INVENTION

This present invention is very simple and comprises only five independent assembled components. It is quickly to be assembled and disassembled by eight sets of screw-nuts securements. When disassembled, it can be put into a portable bag for later use.

Each of a pair of substantially triangular shaped bases includes a floor beam, a vertical upright beam, and two angular strut beams, made of aluminum alloy hollow square-shaped tube.

The floor beam is longitudinally disposed upon a ground surface in parallel with a patient lying at prone (or supine) position proximal thereto. The floor beam includes a pair of ends and midpoint equidistantly disposed between each of the pair of ends. The vertical upright beam is endwise disposed perpendicularly upon floor beam at the midpoint. Each of the pair of side struts is disposed on either side of the upright beam, conjoining the floor beam at the middle point of each half floor beam. Each of the pair of side struts supports the upright beam in perpendicular position at the floor beam midpoint.

The upper portion, or say attachment section, of the vertical upright beam of each of a pair of substantially triangular shaped bases mounted with the lower portion of each independent vertical upright beams, by a square-shaped-tube-telescope structure becomes a stand assembly, and can be secured together rigidly by two sets of special screw-nuts securements, to provide two selectable height positions.

And also the upper portions of each independent upright beam of a pair of stands assembly mounted with each of a pair of the vertical strut members of the grabbing bar assembly, by a square-shaped-tube-telescope structure, become an entire grabbing bar rack, and can be secured together rigidly by two pairs of special screw-nuts securements, and to provide two selectable height positions too, described subsequently in greater detail.

The grabbing bar assembly includes a pair of parallel bars endwise interconnected with each of a pair of vertical strut members. Each of the pair of parallel bars are contemplated to by cylindrically shaped with a round-shaped transverse cross-section conformable to grasping and manual engagement by a user and for support the user's abdomen when applying bodyweight to the bars. Each of the pair of parallel bars is oriented to span horizontally, vertically aligned, between the upper portions of the independent upright beams of each of the first and second side stands assembly. The present moveable barefoot massage grabbing bar rack, therefore, includes a first and second side stands assembly, positional in parallel array spaced apart and secured together by a grabbing bar assembly secuarbly fittable spanned therebetween.

The said independent vertical upright beam is a metal square-shaped tube, made of galvanized steel; its outside transverse cross section is a little smaller (one millimeter difference) than the inside transverse cross section of the aluminum alloy square-shaped tubes of both the substantial triangular shaped base and the substantial rectangular shaped grabbing bar assembly, so that the independent vertical upright beam is easily to slide in outer square-shaped tubes, to become square-shaped-tube-telescope structure. At each upper and lower portion of said independent vertical upright beam, there are four round holes three and one-half (3.5) inches apart serried vertically and to become two pairs of anchor points of a pair of odd number holes and a pair of even number holes respectively, and each anchor point of two round holes set apart seven inches. So that the interconnections of the independent vertical upright beam with both the substantial triangular shaped base and the substantial rectangular shaped grabbing bar assembly have two height positions for user's selection respectively, caused there are three height positions of the entire grabbing rack to fit the various heights of different users.

Further, the four interconnections of the independent vertical upright beam and both the substantial triangular shaped base and the substantial rectangular shaped grabbing bar assembly are of four square-shaped-tube-telescope structures, that not only enable quick assembled and disassembled, and also allow users to have two or three pairs of independent vertical upright beams with different lengths, due to different raised surface or a ground surface, such as massage table or massage mat on the floor.

This present invention has a new idea for screw-nuts securement. The said screw-nuts securement is tightened in the hollow of outer aluminum alloy square-shaped tube, only inside surface of the outer square-shaped tube contacts the outside surface of independent upright beam, utilizing one copper tube-sets to go through the round hole of the wall of the outer square-shaped tube to transfer the pressure from the screw knob of the screw with shank onto the surface of the independent vertical upright beam, tightened by a set of screw and nuts, and washers, as well as said copper tube-sets.

Thus has been broadly outlined the more important features of the present moveable barefoot massage grabbing bar rack so that the detailed description thereof that follows may be better understood and in order that the present contribution to the art may be better appreciated.

Objects of the present moveable barefoot massage grabbing bar rack, along with various novel features that characterize the invention are particularly pointed out in the claims forming a part of this disclosure. For better understanding of the moveable barefoot massage grabbing bar rack, its operating advantages and specific objects attained by its uses, refer to the accompanying drawings and description.

BRIEF DESCRIPTION OF THE DRAWINGS

Figures

FIG. 7 is a side view of an example embodiment of a first side stand assembly FIG. 8 is a front view of an example embodiment of a first side stand assembly.

FIG. 9 is a transverse cross-section view of an example embodiment of the square-shaped-tube-telescope structure of a first side stand assembly, taken along the line D-D in FIG. 7.

FIG. 9

FIG. 9

DETAILED DESCRIPTION OF THE DRAWINGS

Figure 1:
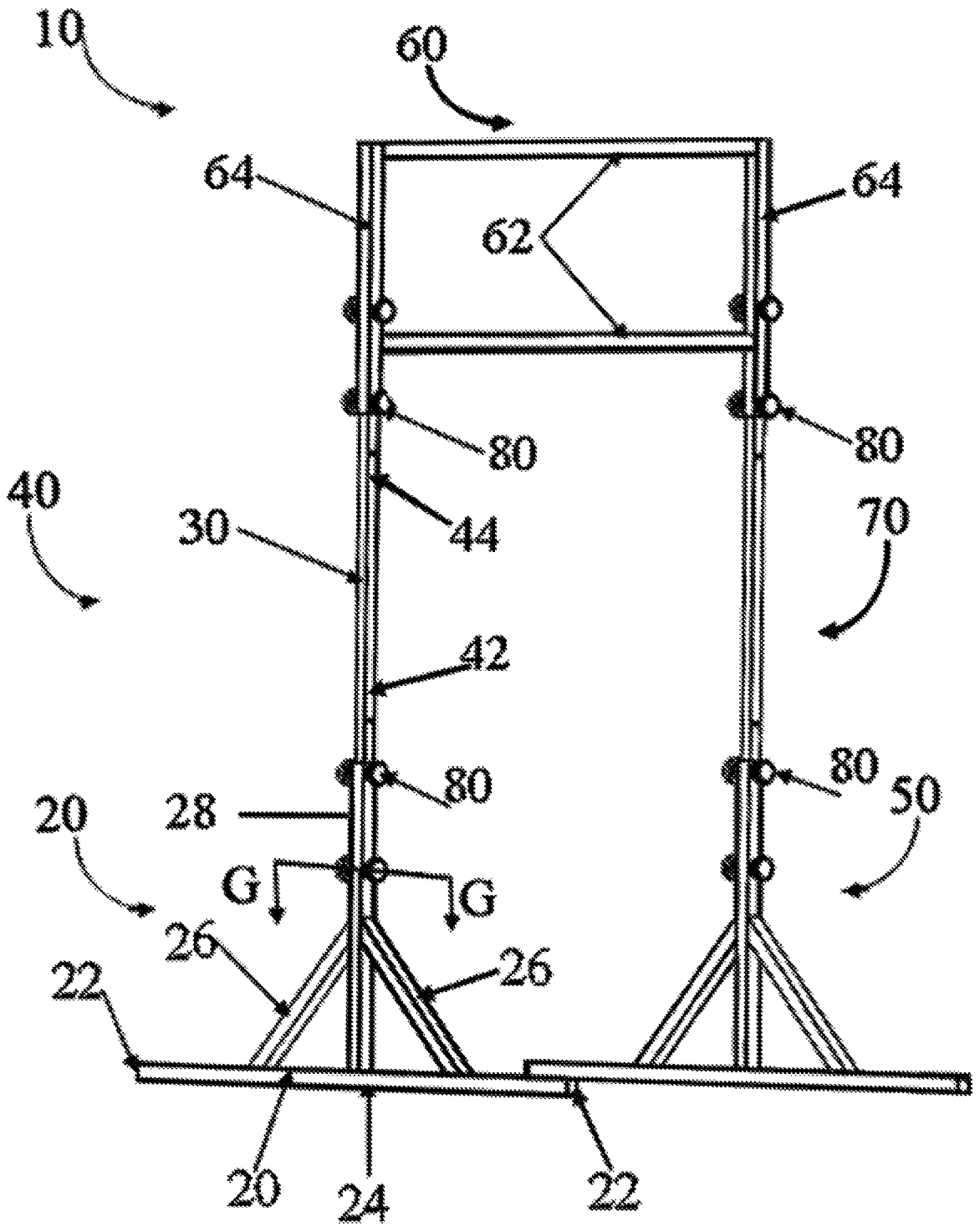
FIG. 1 is an isometric view of preferred embodiment of the present invention.

With reference now to the drawings, and in particular FIGS. 1 through 17, thereof, example of the instant moveable barefoot massage grabbing bar rack employing the principles and concepts of the present moveable barefoot massage grabbing bar rack and generally designated by the reference number 10 will be described.

The present moveable barefoot massage grabbing bar rack 10 has been devised to enable a user to perform barefoot massage upon a prone or supine position patient without requiring any grabbing bars permanent installation at any single location. The present moveable barefoot massage grabbing bar rack 10 comprises five independent components: the first side substantial triangular shaped base 20, the second side substantial triangular shaped base 50, these two substantial triangular shaped bases mounted with the lower portion of a pair of independent upright beams 30 to become the first and the second side stand assembly 40, 70, as well as the substantial rectangular shaped grabbing bar assembly 60 on the top.

Each of the first and second side substantial triangular shaped base 20, 50 includes a floor beam 20, the vertical upright beam 28 and a pair of angular strut members 26. The floor beam 20 includes a pair of ends 22 and a midpoint 24. The vertical upright beam 28 is disposed perpendicularly endwise at the midpoint 24 of the floor beam 20 to maintain the vertical upright beam 28 aloft vertically situated above the midpoint 24 of the floor beam 20. Each of the pair of strut members 26 is angularly disposed diagonally connecting the upright beam 28 to the floor beam 20 at the midpoint of each half floor beam. Each of the first and second side substantially triangular shaped base 20, 50 is therefore positional spaced apart with each of the associated vertical upright beams 28 disposed in parallel relation.

Moreover, each of the substantial triangular shaped base 20, 50 mounted with each lower portion of the independent vertical upright beam 30 becomes the first and the second side stands assembly 40, 70, and also therefore positional spaced apart with each of the associated independent upright beams 30 disposed in parallel relation.

The first and second stands assembly 40, 70 mounted with the pair of upright strut members 64 of grabbing bar assembly 60 become the entire grabbing bar rack 10. The grabbing bar assembly 60 is attachable to the upper portion 44 of the independent vertical upright beam 30 of each of the first and second side stands assembly 40, 70. When secured to each of the first and second side stands assembly 40, 70, the grabbing bar assembly 60 is disposed in a plane perpendicular to each floor beam 20. The grabbing bar assembly 60 thus fixes the first and second side stands assembly 40, 70 together to prevent toppling, shaking, securely spanning between each of said first and second side stands assembly 40, 70, because each of four square-shaped-tube-telescope, shown on FIG. 9, has the same ordination, and be placed in the same plane perpendicular to the floor beams, shown on FIG. 14.

Figure 10:
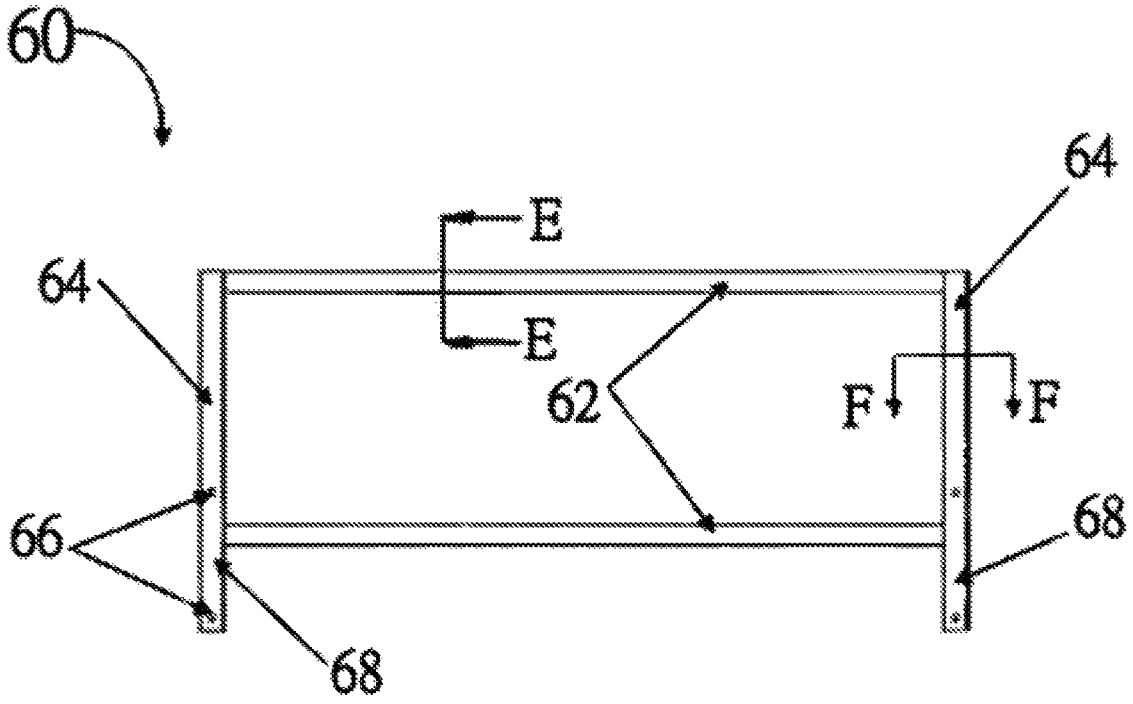
FIG. 10 is a front view of an example embodiment of substantial rectangular shaped grabbing bar assembly.
Figure 11:
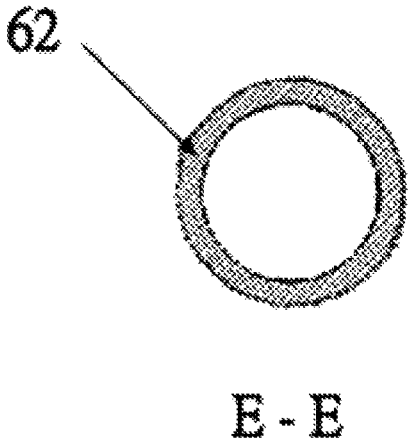
FIG. 11 is a transverse cross-section view of an example embodiment of one of a pair of parallel round-shaped bars, taken along the line E-E in FIG. 10.

In the example embodiment depicted in FIG. 10, the grabbing bar assembly 60 includes a pair of parallel bars 62 disposed spaced apart and endwise connected to each of a pair of vertical strut members 64. The length of each of the pair of parallel bars 62 is contemplated to be thirty-six (36) inches, and the length of each of the pair of vertical strut members 64 is contemplated to be twenty (20) inches. Thus, in this embodiment, the pair of parallel bars 62 is disposed approximately twelve (12) inches spaced apart. Each of the pair of parallel bars 62 is contemplated to be cylindrical with a round-shaped transverse cross-section, the better for grasping comfort by a user manually engaging each of the pair of parallel bars 62 and contacting upper bars 62 with the abdomen. In the example embodiment depicted in FIG. 10, each of the pair of parallel bars 62 has a diameter of one and three-sixteenth (1 3/16) inches.

Figure 12:
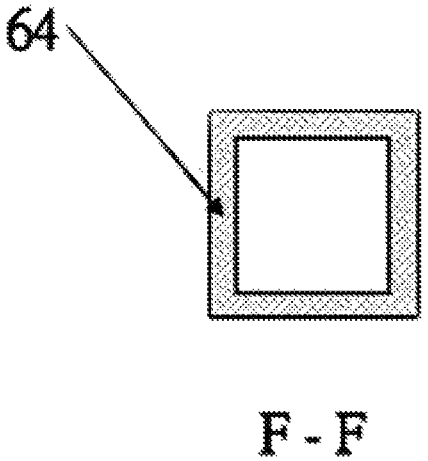
FIG. 12 is a transverse cross-section view of example embodiment of one of a pair of vertical square-shaped strut members, taken along the line F-F in FIG. 10
Figure 13:
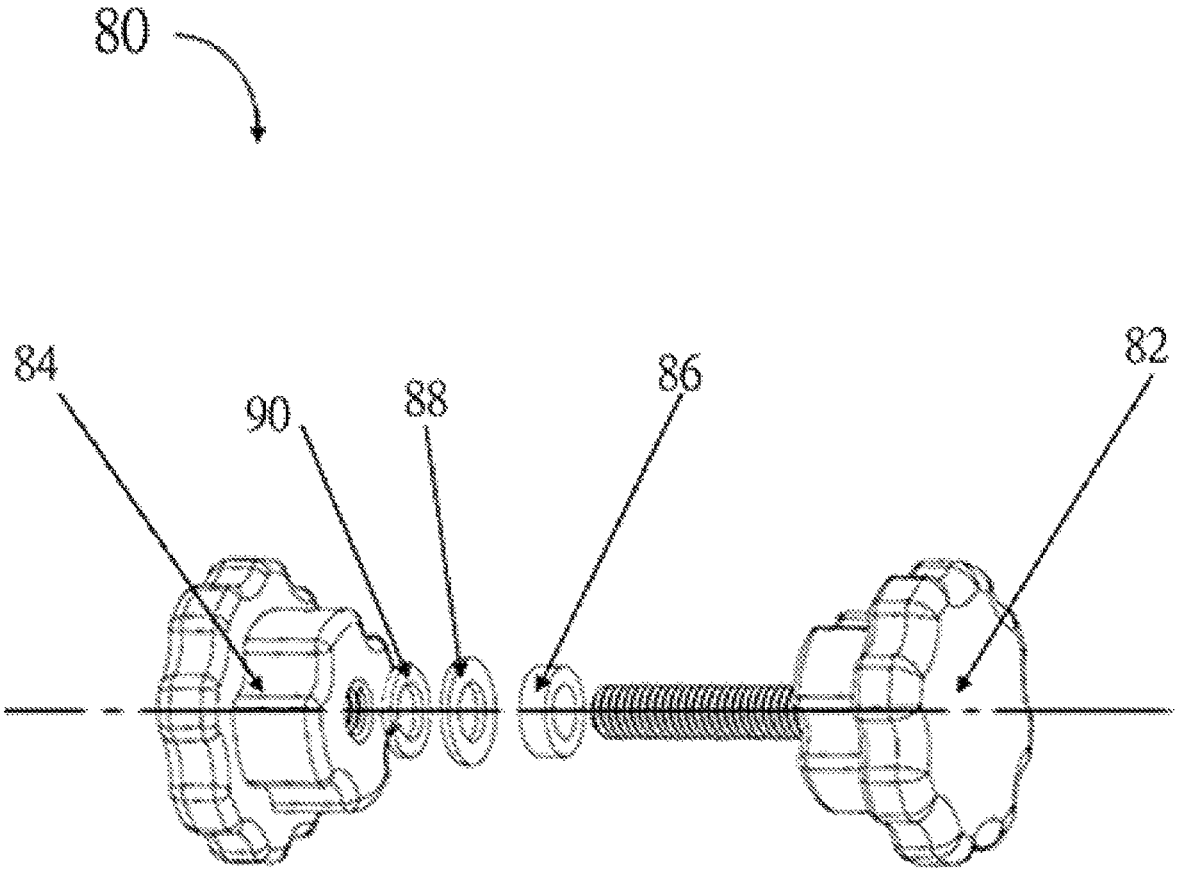
FIG. 13 is an isometric view of example embodiment of a set of screw-nuts securement.
Figure 14:
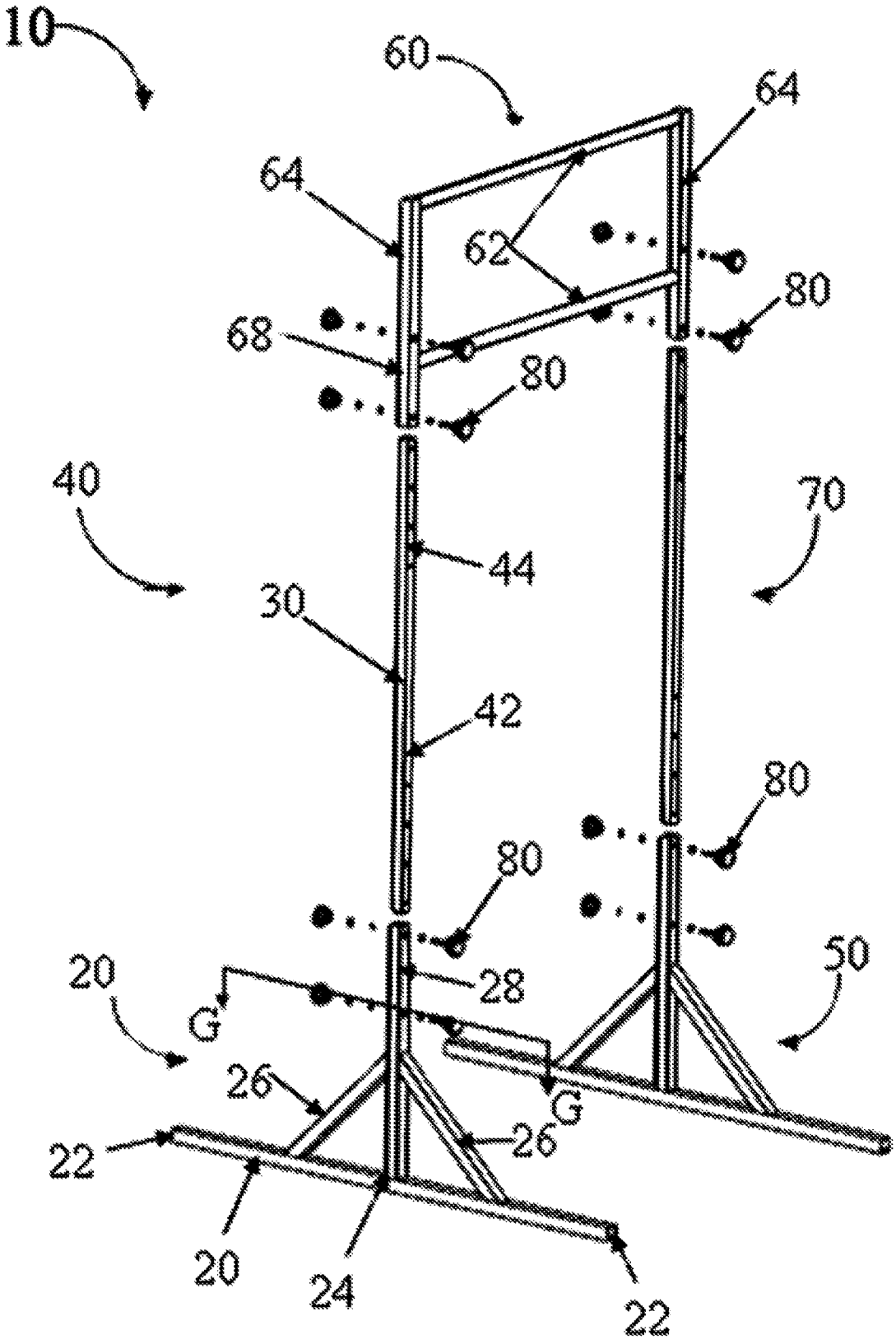
FIG. 14 is an exploded view of reference number 10 in FIG. 1.

The transverse cross-section of each of the pair of vertical strut members 64, however, as shown in FIG. 12 is contemplated to be square-shaped tube and one and three-sixteenth (1 3/16) inches outer sides, whereby each of the pair of vertical strut members 64 includes an attachment section 68 positional in flush contact with the upper attachment section 44 of the independent vertical upright beam 30 of the first and second side stands assembly 40, 70.

Figure 5:
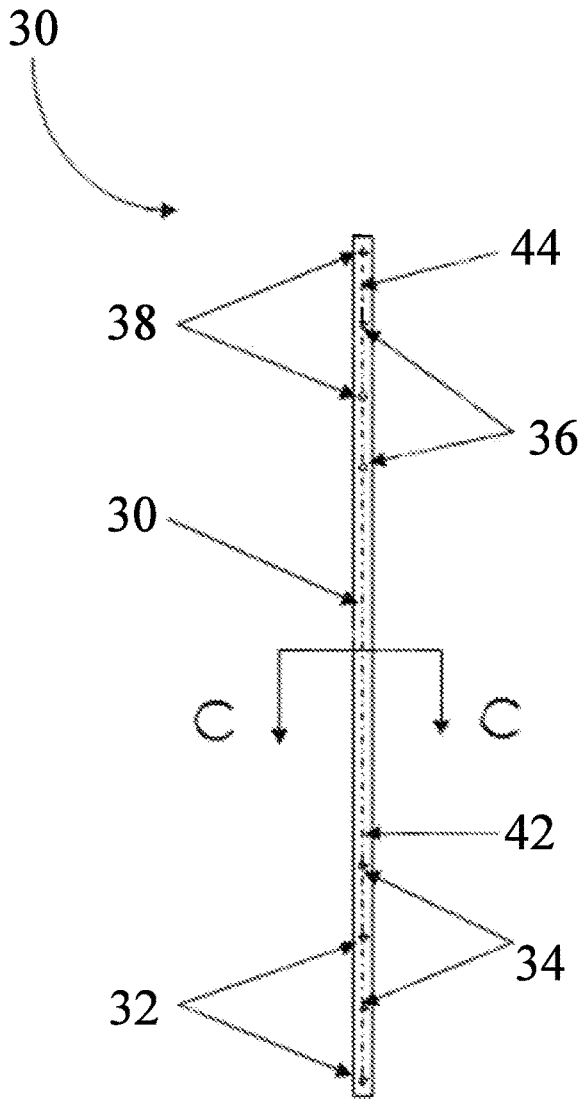
FIG. 5 is a front view of an example embodiment of a first side independent vertical upright beam.
Figure 6:
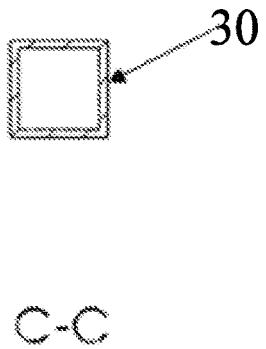
FIG. 6 is a transverse cross-section view of an example embodiment of a first side independent vertical upright beam, taken along the line C-C in FIG. 5.

In the example embodiment depicted in FIG. 5 and FIG. 10, the upper attachment of the independent upright beam 30 of each of the first and second side stands 40, 70 includes four round holes disposed three and one-half (3.5) inches apart serried vertically, each pair of odd and even number holes become two pairs of anchor points 36, 38, connected to each attachment section 68 of the pair of vertical strut members 64 is securable at the anchor points 66, of a pair of holes disposed seven (7) inches apart vertically thereupon. Therefore, with a desired pair of anchor points 36 and 38 enables the grabbing bar assembly 60 at a desired adjustable height positions of three and one-half (3.5) inches difference.

In the example embodiment depicted in FIG. 5 and FIG. 8, the lower attachment section 42 of the independent vertical upright beam 30 of each of the first and second side stands assembly 40, 70 includes four round holes disposed three and one-half (3.5) inches apart serried vertically, each pair of odd and even number holes becomes two pairs of anchor points 32, 34, connected to each of upper portion of the pair of the vertical upright beam 28 of the substantial triangular shaped bases 20, securable at the anchor points 46, with which a pair of holes disposed seven (7) inches apart vertically. Therefore, with a desired a pair of anchor points 32 and 34 enables the entire rack getting two more adjustable height positions of three and one-half (3.5) inches difference.

It should be readily understood by anyone having skills in the pertinent art that additional means of securement of the grabbing bar assembly 60 with height relate to floor beams is adjustable between seven inches of 3 positions is contemplated as part of this disclosure.

The first and second side substantial triangular shaped bases 20, 50 are contemplated to be manufactured of aluminum alloy square-shaped tubes, and the grabbing bar assembly 60 of aluminum alloy square-shaped and round-shaped tubes, or another lightweight, hollow metal, whereby the weight of each of the first and second side substantial triangular shaped bases 20, 50 and the grabbing bar assembly is controllable within acceptable norms for portability yet tensile strength and rigidity is maintained capable of supporting an adult human prostrating on the grabbing bar assembly 60 when said grabbing bar assembly 60 is secured spanning between each of the first and second side stands assembly 40, 70. The independent upright beam 30 is made of galvanized steel square-shaped tube and has rigid supporting features.

Figure 2:
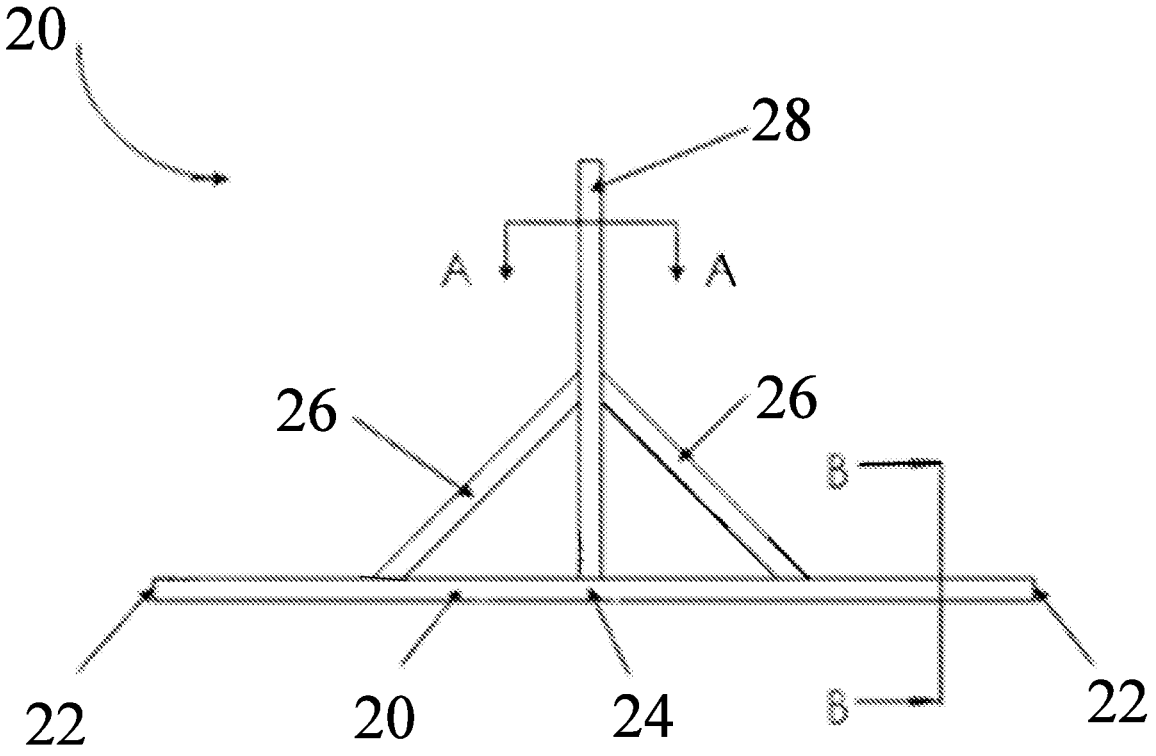
FIG. 2 is a side view of an example embodiment of a first side substantial triangular shaped base.
Figure 3:
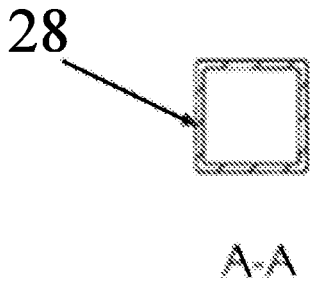
FIG. 3 is a transverse cross-section view of an example embodiment of a substantial triangular shaped base, taken along the line A-A in FIG. 2.
Figure 4:
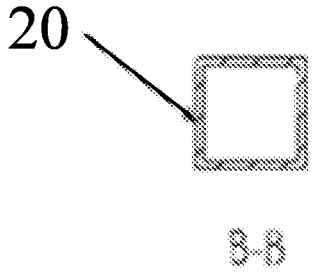
FIG. 4 is a transverse cross-section view of an example embodiment of a first side substantial triangular shaped base, taken along the line B-B in FIG. 2.

In the example embodiment depicted in FIG. 3, vertical upright square tube 28, the transverse cross section A-A of the first and second side substantial triangular bases 20, 50 is configured to be a square-shaped of one and three-sixteenth (1 3/16) inches outer sides. Referring to FIG. 2, the length of each floor beam 20 is contemplated to be forty-eight (48) inches, and the distance between each of the pair of strut members 26, at the point of conjunction with the floor beam 20, is taken to be twenty-four (24) inches. The height at each of the pair of strut members 26 conjoins with the upright beam 28 is taken to be twelve (12) inches, making the length of each strut member 26 approximately seventeen (17) inches. In this embodiment, the length of the upright beam 28 is taken to be at twenty-two and one-half (22.5) inches, however, mounted with the independent upright beam 30, the total height of the stand assembly is approximately fifty-nine (59) inches, and then, the grabbing bar assembly is mounted, so the total utmost height of the grabbing bar rack is about seventy (70) inches. To summarize that the length of the floor beam 20 is at least 65% of the highest measuring of this rack to enable the rack stable.

In an example embodiment contemplated herein, the length of the independent vertical upright beam 30 is changeable due to different raised surface or a ground surface, thus one set of moveable barefoot massage grabbing bar rack may include two or three pairs of independent vertical upright beams with different lengths.

As shown in an example embodiment depicted in FIG. 1, when secured to each of the first and second side stands assembly 40, 70, the grabbing bar assembly 60 is disposed in a plane perpendicular to each floor beam 20 and in the same plane with the pair of the independent vertical upright beams 30. The grabbing bar assembly 60 thus fixes the first and second side stands assembly 40, 70 together to prevent toppling, shaking, securely spanning between each of said first and second side stands assembly 40, 70, because the four square-shaped-tube-telescope structures, 68 versus 44 and 28 versus 42, have ordinations, and be placed in the same orientation of the same plane perpendicular, referring to FIG. 14. and FIG. 9

Figure 15:
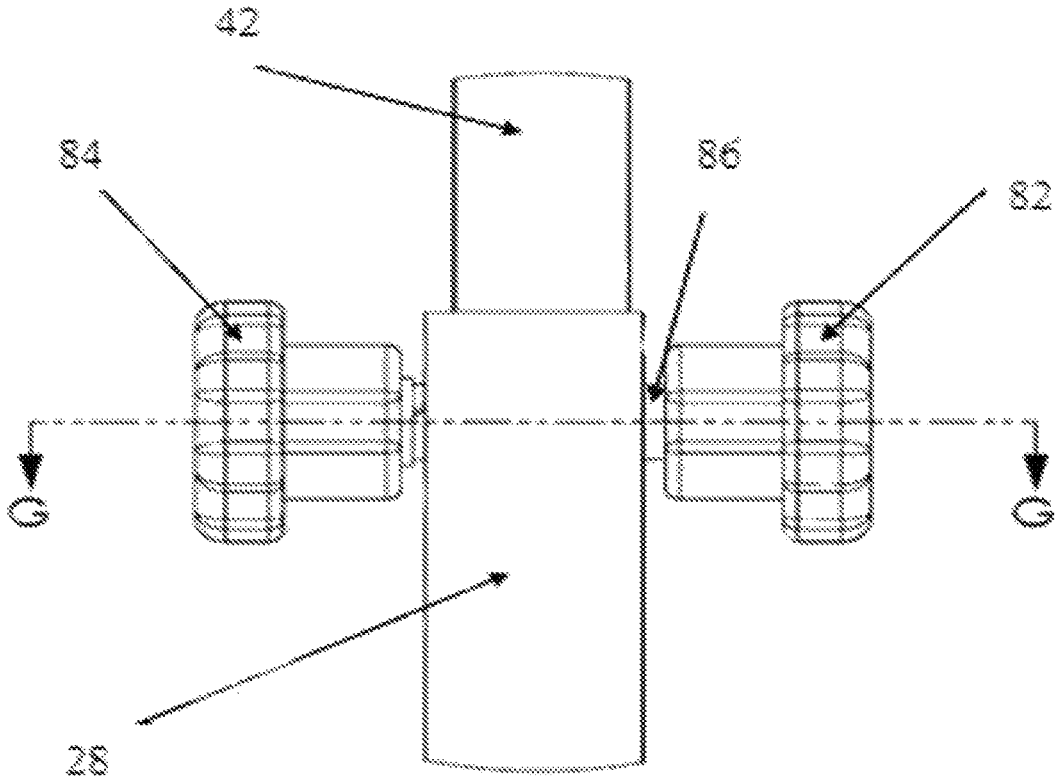
FIG. 15 is a partial side view of the first side stand assembly at G point section of FIG. 1, and referring to FIG. 14.
Figure 16:
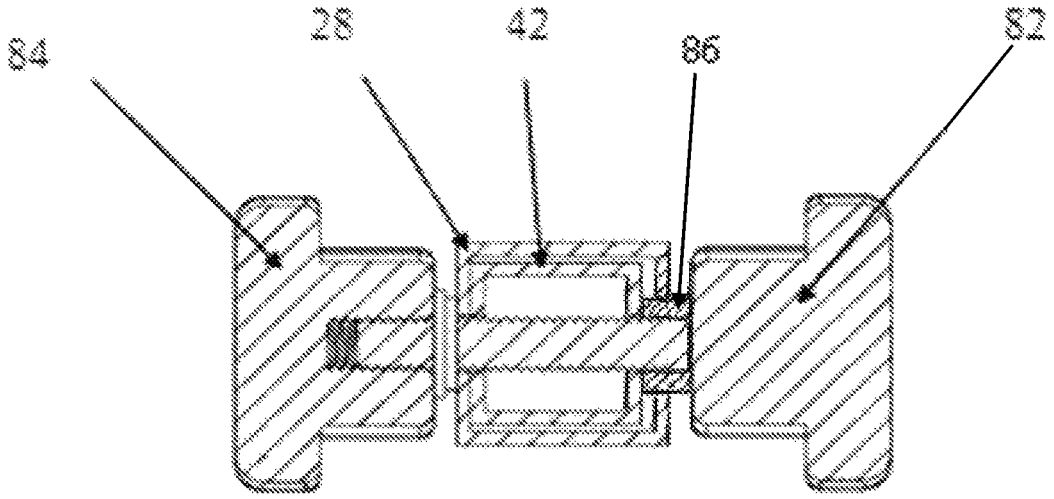
FIG. 16 is a transverse cross-section view of FIG. 15, taken along the line G-G of FIG. 15, and referring to FIG. 1.

As shown in an example embodiment depicted in FIG. 15 and FIG. 16, in order to eliminate the intervals between the independent vertical upright beam 30 and the outer, bigger square-shaped tubes, of both the vertical upright beam 28 of the substantial triangular shaped base 20 and the vertical strut members attachment section 68 of the grabbing bar assembly 60, this invention utilizes a special screw-nuts securement 80; said a special screw-nuts securement 80 is tightened in the hollow of outer square-shaped tubes 28, 64, only making inside surface of the outer square-shaped tubes 28, 68 contacts the outside surface of the independent vertical upright beam 30, utilizing one copper tube-sets 86 to go through the round hole at the wall of the outer square-shaped tubes 28, 68 and to transfer the pressure from the screw knob of the screw with shank 82 onto the outer surface of the independent vertical upright beam 30, tightened by this set of screw and nuts 82, 84, and washers 88, 90, as well as said copper tube-sets 86.

Figure 17:
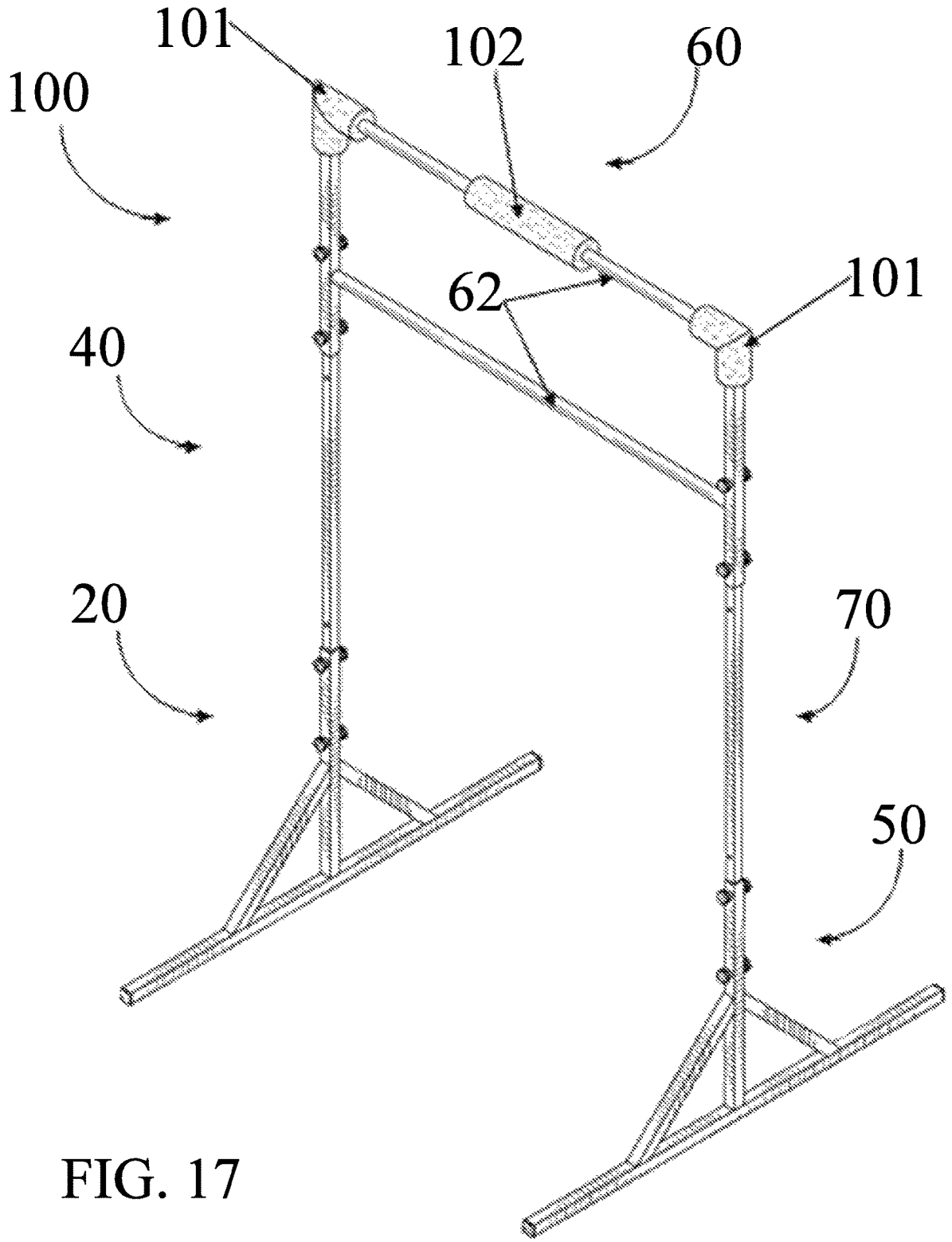
FIG. 17 is an isometric view of another example embodiment. On the top corners of the grabbing bar rack installed a pair of rubber foam corner protection and at the middle area of the top grabbing bar installed a piece of rubber round-shaped cushion.

In another example embodiment 100, shown in FIG. 17, on the upper corners of the grabbing bar assembly 60, there is a pair of metal corner protection 101, made of rubber foam to prevent users or patient from eyes injury; and at the middle area of the upper grabbing bar 62 installed a round-shaped cushion 102, made of softer rubber martial to better conformable for support the users' abdomen when users applying bodyweight onto the upper grabbing bars 62.

What is claimed is:

1. A moveable barefoot massage grabbing bar rack for use in massage treatment, said moveable barefoot massage grabbing bar rack comprising five independent components and eight sets of screw-nut securements, comprising:

a first side substantially triangular shaped base including:

a horizontal floor beam, having two halves, said horizontal floor beam having a pair of ends and a midpoint;

a vertical upright beam, said vertical upright beam having an attachment section at an upper portion, and disposed perpendicularly endwise at the floor beam midpoint;

a pair of strut members angularly disposed connecting the upright beam to the floor beam, each of said pair of strut members diagonally disposed endwise at the midpoint of each half floor beam;

a second side substantially triangular shaped base identical to the first side substantially triangular shaped base, said second side substantially triangular shaped base including:

a horizontal floor beam, having two halves, said horizontal floor beam having a pair of ends and a midpoint;

a vertical upright beam, said upright beam having an attachment section at an upper portion, and disposed perpendicularly endwise at the floor beam midpoint;

a pair of strut members, said pair of strut members angularly disposed connecting the upright beam to the floor beam, each of said pair of strut members diagonally disposed endwise at the midpoint of each half floor beam;

a pair of independent vertical upright beams, connected to respective vertical upright beams of the first and second substantially triangular shaped bases, said pair of independent vertical upright beams having two attachment sections at each upper and lower portion;

a grabbing bar assembly, said grabbing bar assembly having a pair of parallel bars spaced apart and connected to each of a pair of vertical strut members, said pair of vertical strut members including attachment sections mounted with the attachment sections of the upper portion of each of the pair of independent vertical upright beams of each of the first and second stand assemblies;

wherein, the lower portion of each independent vertical upright beam having four round-shaped holes spaced apart vertically, whereby each of the four round-shaped holes is used as anchoring points and for pairing the first side and the second side, connected with the attachment section of the upright beam of the respective substantially triangular shaped base, by a telescope structure;

wherein an assembly of the independent vertical upright beam and the substantially triangular shaped base are arranged as a pair of side stand assemblies, and a height of the assembly of the independent vertical upright beam and the substantially triangular shaped base is selectable at two anchoring point; wherein the upper portion of the independent vertical upright beam having four round-shaped holes spaced apart vertically and each pair of holes being two anchoring points, connected with an attachment section of the pair of upright strut members of the grabbing bar assembly, by the telescope structure; whereby an assembly of the first and second side stand assemblies and the grabbing bar assembly is a grabbing bar rack, and a height of the grabbing bar assembly is determined by the side stand assemblies and is selectable according to two anchoring point positions;

wherein the upper portion and lower portion of the pair of the independent vertical upright beams comprise four telescope structures is perpendicular to a respective floor beam, whereby there are two floor beams oriented in an identical direction to guarantee that the grabbing bar assembly is upright and perpendicular to the two floor beams and the upper portion and lower portion of the pair of the independent vertical upright beams are: (i) parallel to each other and (ii) configured to collapse the rack without a tool;

wherein the eight sets of screw-nut securements each have one metal screw with shank, one metal screw nut, one flat washer and one spring washer located outside of each of the four telescope structures, and the eight sets of screw-nut securements have one copper tube-set located at an end of the metal screws, and disposed through a round hole in each of the four telescope structures to transfer pressure from a knob of the metal screw with shank to an outer surface of the independent vertical upright beams, enabling a friction force created between an inner surface of each of the four telescope structures and the outer surface of the independent vertical upright beams;

wherein the grabbing bar assembly is configurable at a desired height secured between each of the first and second side stand assemblies and a user can manually engage the grabbing bar with the user's abdomen to effect a barefoot massage upon a patient lying thereon, the grabbing bar assembly comprises a piece of round-shaped cushion in a middle area of a upper traversing portion of the grabbing bar assembly connected between the side stand assemblies in order to support the user's abdomen when a user applies bodyweight to the upper traversing portion of the grabbing bar assembly.

2. The moveable barefoot massage grabbing bar rack of claim 1, wherein the grabbing bar assembly further comprising a lower traversing portion of the grabbing bar assembly and is connected between the side stand assemblies wherein together with the upper traversing portion of the grabbing bar assembly constitute a pair of moveable transverse grabbing bars, and are interconnected with a pair of square-shaped tube strut members, for supporting the user's bodyweight.

3. The moveable barefoot massage grabbing bar rack of claim 1, further comprises a pair of metal corner protection composed of rubber foam.

4. The moveable barefoot massage grabbing bar rack of claim 1, wherein the piece of round-shaped cushion is made of softer rubber material and is installed in a middle one-third portion of the upper grabbing bar to support the user's abdomen.

5. A moveable barefoot massage grabbing bar rack for use in massage treatment, said moveable barefoot massage grabbing bar rack comprising five independent components and eight sets of screw-nut securements, comprising:

a first side substantially triangular shaped base including:

a horizontal floor beam, having two halves, said horizontal floor beam having a pair of ends and a midpoint;

a vertical upright beam, said vertical upright beam having an attachment section at an upper portion, and disposed perpendicularly endwise at the floor beam midpoint;

a pair of strut members angularly disposed connecting the upright beam to the floor beam, each of said pair of strut members diagonally disposed endwise at the midpoint of each half floor beam;

a second side substantially triangular shaped base identical to the first side substantially triangular shaped base, said second side substantially triangular shaped base including:

a horizontal floor beam, having two halves, said horizontal floor beam having a pair of ends and a midpoint;

a vertical upright beam, said upright beam having an attachment section at an upper portion, and disposed perpendicularly endwise at the floor beam midpoint;

a pair of strut members, said pair of strut members angularly disposed connecting the upright beam to the floor beam, each of said pair of strut members diagonally disposed endwise at the midpoint of each half floor beam;

a grabbing bar assembly, said grabbing bar assembly having a pair of parallel bars spaced apart and connected to each of a pair of vertical strut members, said pair of vertical strut members including attachment sections mounted with the attachment sections of the upper portion of each of the pair of independent vertical upright beams of each of the first and second stand assemblies;

a pair of independent vertical upright beams, connected to respective vertical upright beams of the first and second substantially triangular shaped bases, said pair of independent vertical upright beams having two attachment sections at each upper and lower portion;

wherein, the lower portion of each independent vertical upright beam having four round-shaped holes spaced apart vertically, whereby each of the four round-shaped holes is used as anchoring points and for pairing the first side and the second side, connected with an attachment section of the upright beam of the respective substantially triangular shaped base, by a square-shaped-tube telescope structure;

wherein an assembly of the independent vertical upright beam and the substantially triangular shaped base are arranged as a pair of side stand assemblies, and a height of assembly of the independent vertical upright beam and the substantially triangular shaped base is selectable at two anchoring points;

wherein the upper portion of the independent vertical upright beam having four round-shaped holes spaced apart vertically and each pair of holes being two anchoring points, connected with an attachment section of the pair of upright strut members of the substantially rectangular shaped grabbing bar assembly, by the telescope structures; whereby an assembly of the first and second side stand assemblies and the grabbing bar assembly is a grabbing bar rack, and a height of the grabbing bar assembly is determined by the side stand assemblies and is selectable according to two anchoring points;

wherein the upper portion and lower portion of the pair of the independent vertical upright beams comprise telescope structures is perpendicular to a respective floor beams, whereby there are two floor beams oriented in an identical direction to guarantee that the grabbing bar assembly is upright and perpendicular to the two floor beams and the upper portion and lower portion of the pair of the independent vertical upright beams are: (i) parallel to each other and (ii) configured to collapse the rack without a tool;

wherein the eight sets of screw-nut securements each have one metal screw with shank, one metal screw nut, one flat washer and one spring washer located outside of each of the four telescope structures, and the eight sets of screw-nut securements have one copper tube-set located at an end of the metal screws, and disposed through a round hole in each of the four telescope structure to transfer pressure from a knob of the metal screw with shank to an outside surface of the independent vertical upright beams, enabling a friction force created between an inside surface of each of the four telescope structures and an outer surface of the independent vertical upright beams;

wherein the grabbing bar assembly is configurable at a desired height secured between each of the first and second side stand assemblies, whereby a user can manually engage the grabbing bar or prostrate on the upper grabbing bar with the user's abdomen to effect a barefoot massage upon a patient lying thereon.

* * * * *